US007219456B1

(12) United States Patent
Wei et al.

(10) Patent No.: US 7,219,456 B1
(45) Date of Patent: May 22, 2007

(54) FIREPLACE SIMULATOR

(75) Inventors: Wnag Hong Wei, Guangzhou (CN); Ou Jian Xiong, Guangzhou (CN)

(73) Assignee: Winners Products Engineering, Ltd., Causeway Bay (HK)

( * ) Notice: Subject to any disclaimer, the term of this patent is extended or adjusted under 35 U.S.C. 154(b) by 0 days.

(21) Appl. No.: 11/281,786

(22) Filed: Nov. 17, 2005

(51) Int. Cl.
*G09F 19/00* (2006.01)

(52) U.S. Cl. ..... 40/428; 392/348

(58) Field of Classification Search ..... 40/428, 40/432, 434; 392/348
See application file for complete search history.

(56) References Cited

U.S. PATENT DOCUMENTS

| | | | | |
|---|---|---|---|---|
| 1,855,297 | A * | 4/1932 | Lawrence | 40/432 |
| 1,903,537 | A * | 4/1933 | Sutliffe | 40/432 |
| 2,175,072 | A * | 10/1939 | Wompey | 40/432 |
| 3,699,697 | A * | 10/1972 | Painton | 40/428 |
| 5,642,580 | A | 7/1997 | Hess et al. | |
| 6,047,489 | A | 4/2000 | Hess et al. | |
| 6,050,011 | A | 4/2000 | Hess et al. | |
| 6,162,047 | A | 12/2000 | Hess | |
| 6,190,019 | B1 | 2/2001 | Hess | |
| 6,269,567 | B1 | 8/2001 | MacPherson et al. | |
| 6,350,498 | B1 | 2/2002 | Hess et al. | |
| 6,363,636 | B1 | 4/2002 | Hess et al. | |
| 6,385,881 | B1 | 5/2002 | Hess | |
| 6,564,485 | B1 * | 5/2003 | Hess | 40/428 |
| 6,580,228 | B1 * | 6/2003 | Chen et al. | 315/185 R |
| 6,615,519 | B2 | 9/2003 | Hess | |
| 6,691,440 | B1 | 2/2004 | Petz et al. | |
| 6,718,665 | B2 | 4/2004 | Hess et al. | |
| 6,846,094 | B2 * | 1/2005 | Luk | 362/252 |
| 2005/0252051 | A1 * | 11/2005 | Chen | 40/428 |
| 2006/0213097 | A1 * | 9/2006 | Haugom | 40/428 |

* cited by examiner

*Primary Examiner*—Cassandra Davis
(74) *Attorney, Agent, or Firm*—John C. McMahon

(57) ABSTRACT

A simulator for providing a user with a simulated burning log display having a generated flickering flame image. The flame image is generated by rotating a shaft with a helically wound light array such that the lights reflect off of a flame shaped mirror onto a partially transparent screen so as to give the impression to a viewer of flickering flames appearing on a front side of the screen and behind a non burning pile of logs.

12 Claims, 4 Drawing Sheets

FIREPLACE SIMULATOR

BACKGROUND OF THE INVENTION

The present invention is directed to a burning log simulator having a simulated flickering flame effect to be utilized as an insert into a conventional fireplace or as a stand alone unit.

Fire simulating devices are popular throughout the world. They can be used to simulate the flickering and glowing effects of a fire so as to give ambiance to a room. Alternatively, they can be used to generate heat in a room by a source other than the actual burning of wood, for example, an electrical heater. Yet further, both effects can be used simultaneously.

If a user has an existing wood burning fireplace, such a device as the invention can be used as an insert into the fireplace and thereby avoid the trouble, mess and danger associated with a wood fire. If there is no existing wood burning fireplace, the device may be constructed to wall mount to give the appearance of a fireplace or may be constructed as a stand alone structure with the appearance of a stove or the like.

The key aspect of such a fire simulating device is to provide a visual appearance of a burning wood fire with flame flickering. The prior art has developed many different types of complex mechanical structures for creating the flickering effect, such as metallic strips that reflect light and that are rotated on a belt with or without a fan to further cause motion in the strips and change the angle of reflectance.

The present invention was developed to provide a simple and effective structure for providing the flame flickering effect.

SUMMARY OF THE INVENTION

A wood fire simulator comprising a housing, a rotatable shaft with a helical wound light array thereon, a mirror in the shape of flames that is positioned to receive light from the shaft and a screen sized and positioned to receive light reflected by the mirror on one side and transmit such light to a viewer in the form of a flickering flame image on the opposite side thereof. In this manner, as light is generated by the helical wound array which is rotated, a continuously changing pattern of the light from shaft strikes the mirror and is reflected thereby to the screen where it is seen by a viewer as a generally flame shaped and flickering image.

Located forward of the screen and positioned in a grating type setting are logs. The logs may be simulated to appear as wooden logs and constructed of plastic or the like or, alternatively, may be non consumed real wood. The logs are located so that the flame image is behind and above them, such as to give a viewer the impression that the logs are on fire and that such fire is producing the flames that are seen above the logs, but are actually only an image on the screen.

The simulator also includes a heating element. For example, the heating element may be of a resistive electrical type wherein metal wires or conductors heat when an electrical current is passed through them. The heating element may use other radiant, conductive or convective types of heaters and further may include a fan to convey air across the heating element and out into the surrounding room.

A second light source is provided to illuminate red and/or orange structure at the base of the logs to simulate glowing embers. The second light source is normally controlled so as to be on or active when the shaft is rotating.

A control mechanism allows a user to turn on and off the rotation of and the lights associated with the shaft. The control mechanism also allows a user to turn on and off the heating element independent of operation of the shaft.

OBJECTS OF THE INVENTION

Therefore, the objects of the present invention are: to provide a simulator that avails a viewer with an image that simulates the flickering light emanating from a burning wood fire; to provide such a simulator that utilizes a rotating shaft having a helical wound light array thereon as a light source for the image which is reflected by a flame shaped mirror or mirrors to a screen that transmits the light therethrough to the viewer in the form of a flickering image; to provide such a simulator that includes a non wood burning heating element that may be used cooperatively in combination with the light image or by itself to heat a surrounding room; to provide such a simulator that includes controls to allow a user to select an operating mode and also includes lighting to simulate glowing embers of a fire; and to provide such a simulator which is easy to manufacture, relatively inexpensive to produce and especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
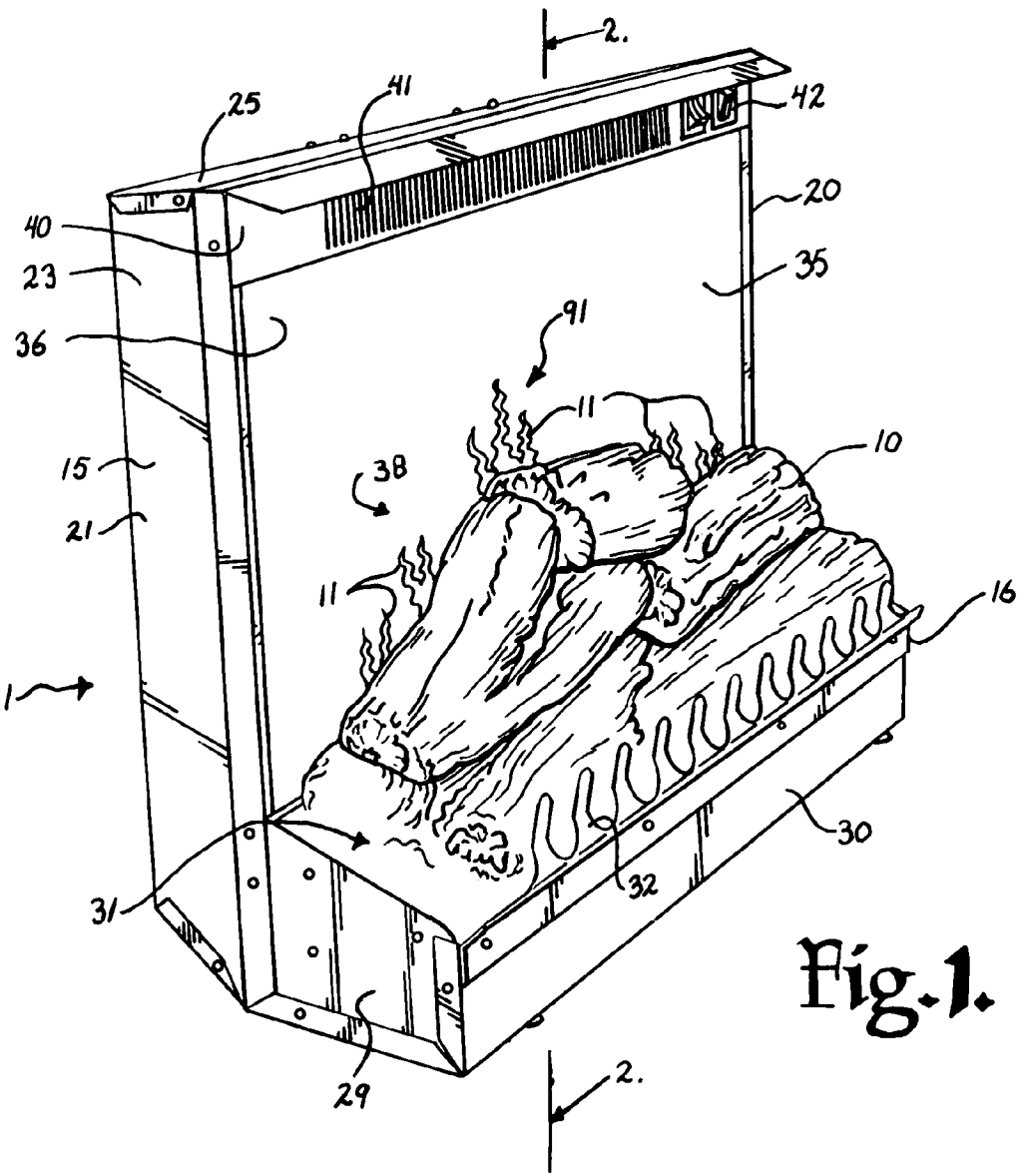
FIG. 1 is a perspective view of a wood burning simulator in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally represents a wood burning fireplace simulator that provides a simulated pile of logs 10 behind which is located an image 11 of a flickering flame that may be viewed by a user in such a manner that the user perceives a visual effect of a burning pile of logs in a fireplace. The user may also elect to have the simulator 10 produce heat with or without the visual effect.

The simulator 1 includes a housing 15 with a forward projecting log receiving region 16 that is designed to simulate the bed of a fireplace. The simulator 1 of the illustrated embodiment is sized and shaped to fit as an insert in a conventional wood burning fireplace. However, it is foreseen that such a simulator may be constructed as a stand alone unit to simulate a wood burning stove used for heating, a wall mounted fireplace or the like.

The housing 15 includes two rear half side walls 20 and 21 and a rear panel 22 that form a continuous partial enclosure covered by a top panel 24. The housing 15 also includes two forward projection partial lower side panels 28 and 29 joined by a front panel 30 that together form a simulated receiver or hot box 31 located beneath the pile of logs 10. A grate finger structure 32 extends upward from a front side of the hot box 31 which is otherwise open above for the purpose of receiving and illuminating the pile of logs 10, as described below.

Located on the front side of the housing structure 23 and rearward of the pile of logs 10 is a screen 35. The screen 35 is preferably constructed of glass that has the optical properties that it is generally reflective of light striking the front side 36 thereof and is generally transitive of light striking the rear side 37 thereof. Glass of this type is readily available and is often referred to as a one way mirror. Portions of the glass screen 35 may be blackened or otherwise treated to leave only the region 38 near or directly behind the pile of logs 10 as transmitting. This may also be accomplished by other structures such as an interior metal shroud or the like. A bottom panel 39 extends over the entire simulator lower side and joins the structure 23 and simulated hot box 31.

Located above the screen 35 and below the top panel 25 is a comparatively narrow panel 40 with vents 41 therein and an operator control station 42 located thereon. A lower side to side panel 43 is located beneath the screen 35. A slot 44 extends along panels 40, 20, 44 and 21 to receive the screen 35.

Positioned on the interior of the simulator rear structure 23 are two side cowlings 45 and 46 and an upper cowling 47 that join to form a generally open rearward region 49 with the rear panel 22 located behind the screen 35.

Positioned on the bottom panel 39 on the side of the hot box 31 are a pair of vertical side to side walls 55 and 56. The rearmost wall 55 is joined to two upright and facing C-shaped and spaced support channels 58 and 59.

Pivotally mounted on each of the channels 58 are first and second ends 60 and 61 respectively of a shaft 62. The shaft 62 is horizontally aligned and extends from side to side. Axially projecting from the shaft ends 60 and 61 are axially aligned rods 63 and 64 respectively. The rod 63 is pivotally received in a bore (not seen) in channel 58 and the rod 64 is pivotally received in and extends through a bore (not seen) in channel 59.

Mounted on a back side of the channel 59 is a motor 70 that receives and operatively rotates the shaft 62 when activated. Located opposite the motor on the shaft 62 are a pair of circumferential and spaced electrical contacts 72 and 73 which operably are engaged by a pair of braised electrical followers 74 and 75. The contacts 72 and 73 are in turn electrically connected to a paired wire 76 that is helically wound about the length of the shaft 62. A plurality of led (light emitting diode) lights 79 are mounted along the wire 76 to form an array 80.

It is foreseen that the array 80 could be provided by other structure such as a large light contained within the shaft and projecting from multiple openings or windows along the shaft.

The lights 79 are preferably arranged in a helically wound path about the shaft 62 at an angle of approximately 45 degrees with respect to an axis. A of rotation of the shaft 62 and are generally tightly spaced relative to one another.

Figure 3:
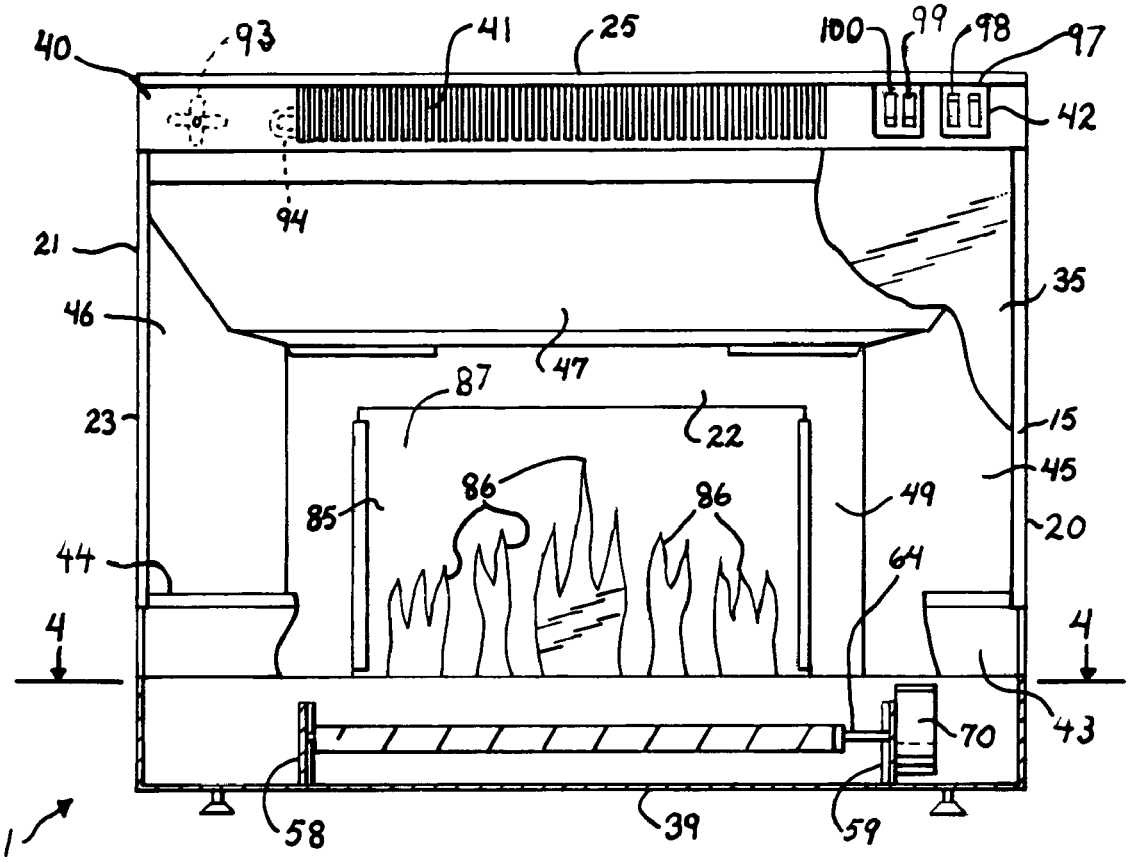
FIG. 3 is a cross sectional view of the simulator, taken along line 3—3 of FIG. 2 with a front screen mostly broken away and other portions broken away to show interior detail thereof.
Figure 4:
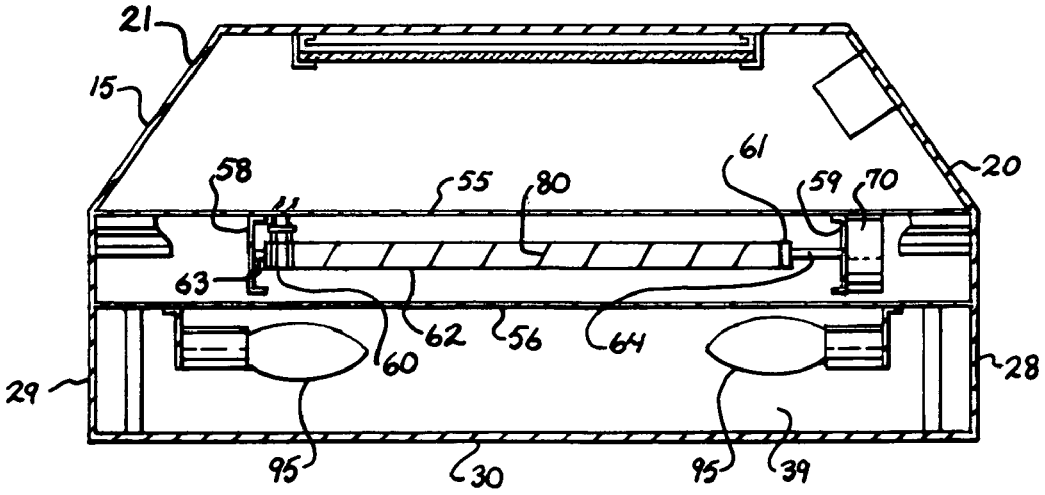
FIG. 4 is a cross sectional view of the simulator, taken along line 4—4 of FIG. 3.
Figure 6:
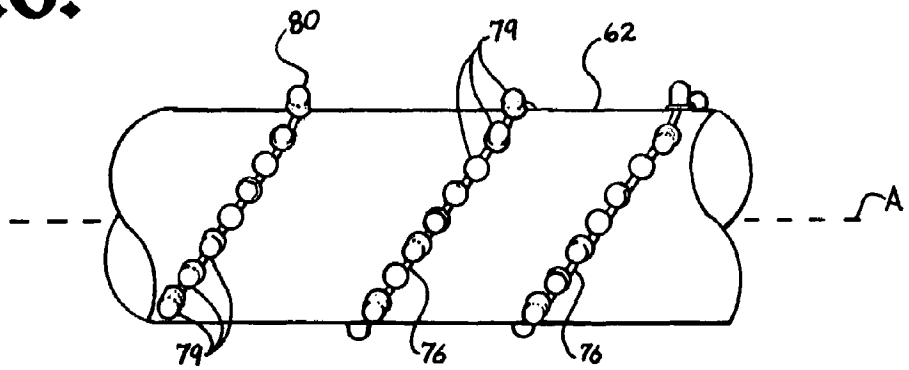
FIG. 6 is a fragmentary and yet further enlarged view of the shaft taken from the view shown in FIG. 4.
Figure 5:
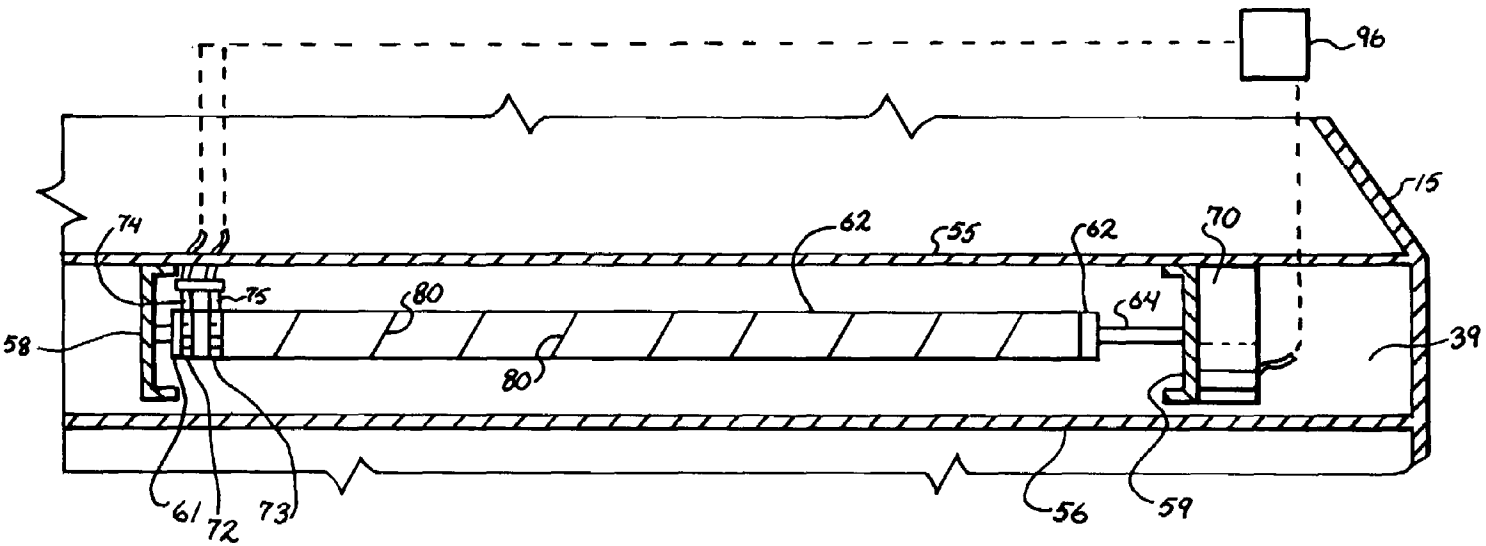
FIG. 5 is a fragmentary and enlarged view of the simulator showing a portion of the view seen in FIG. 4, especially showing a rotatable shaft with a helical wound light array thereon.

Positioned on the inside of the rear panel 22 is a mirror 85. The shape of the mirror 85 is best seen in FIG. 3 and includes a plurality of fire or flame shaped segments 86. The segments 86 are spaced horizontally from side to side across the rear panel 22. The segments 86 are highest in the middle and lowest on the outer sides. Preferably, the segments 86 are mirrored regions formed on an otherwise blackened glass panel 87.

Figure 2:
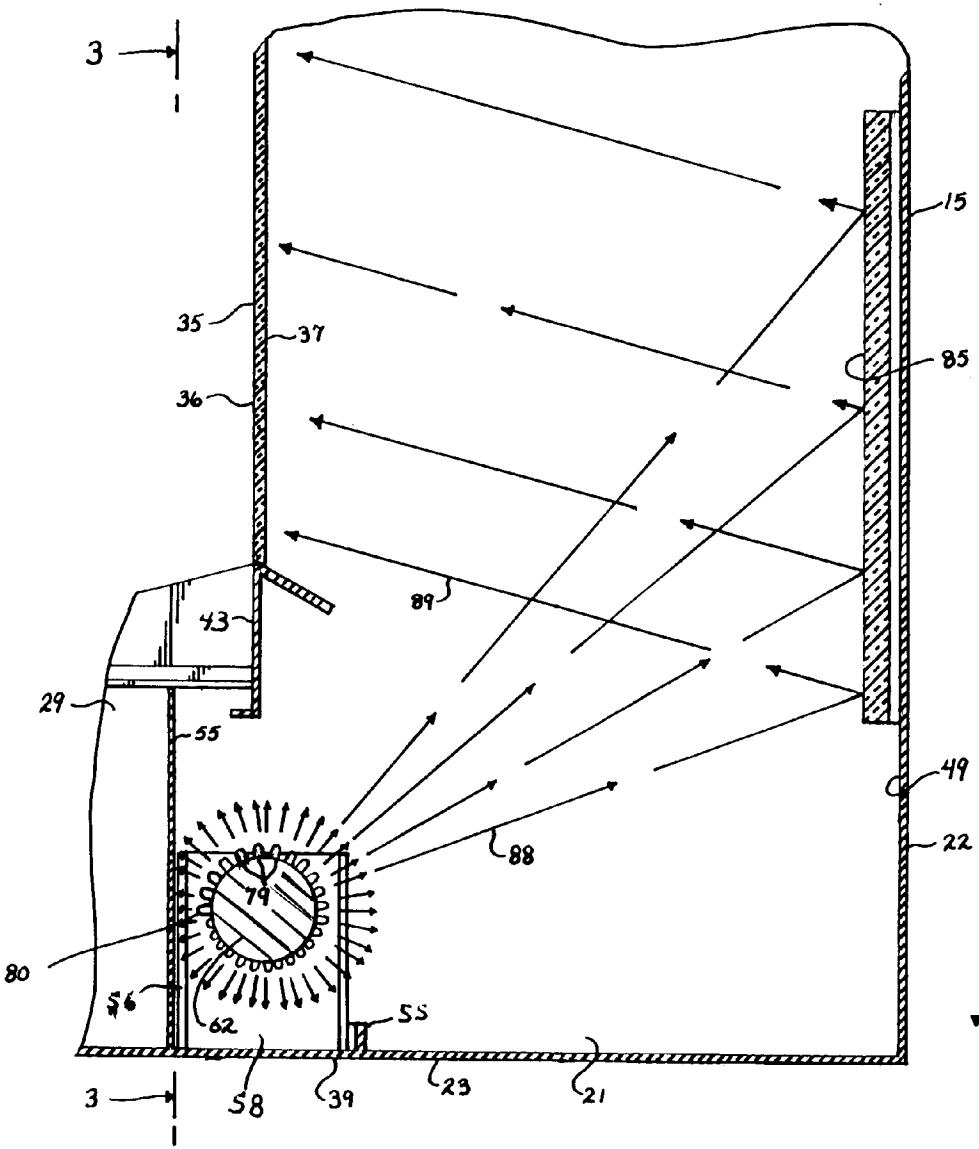
FIG. 2 is an enlarged and fragmentary cross sectional view of the simulator, taken along line 2—2 of FIG. 1.

During operation, light produced by the lights 79 of the array 80 continuously rotate with the shaft 62 which is rotated about its side horizontally aligned axis by the motor 70. As is shown in FIG. 2, certain of the lights 79 are aligned to shine on the mirror 85 at any particular instant and such light is represented by rays 88. The lights 79 and the position of the lights 79 that shine on the mirror 85 change continuously due to the rotation of the shaft 62.

A substantial portion of the light of the rays 88 reflects off the mirror 85 and shines on the rear side 37 of the screen 35 which is represented by rays 89. The light rays 89 substantially transmit through the screen 35 and are seen by a viewer looking at the screen front side 36 as an image 91 located on the screen 35. Because the lights 79 of the array 80 are constantly rotating so as to change position and as some of the lights 79 are continuously passing out of view of the mirror 85 and other lights 79 are continuously passing into view of the mirror 85 (that is, they shine on and reflect off the mirror 85 when in such a position), the pattern reflected by the mirror 85 and consequently, the pattern of the screen image 91 is continuously changing. As the image 91 includes generally flame shaped regions and as the light forming them is changing continuously, the flame shaped image 91 has a flickering appearance which mimics a flame associated with a real burning log. Because the image 91 is located behind and extends above the pile of logs 10, a viewer senses or appears to see the logs burning as if they were on fire. Preferably, the lights 79 are an orange or yellow flame color, although such an effect may be provided by tinting of the rear side 37 of the screen 35.

Located behind the vent 41 is a fan 93 and an electrical heater element 94. Located beneath the pile of logs 10 in the fire hot box 31 are a pair of lights 95 which are on a control circuit that continuously varies intensity when operating. When illuminated, these lights 95 diffusely penetrate through the pile of logs 10 to simulate the glow of a fire and embers therein.

The control station 42 is connected electrically to an electrical circuit generally identified by the schematic electrical control box 96. The control station includes first, second, third and fourth toggle switches 97, 98, 99 and 100. The switch 97 turns on or off the simulator 1. The switch 98 turns on or off the flame simulating structure (motor 70, shaft 62 and lights 79) to produce the visual image 91. Switch 99 turns on or off the heater element 94. The various electrical components are joined to the control box 96 which is in turn connected to a power supply suitable for plugging into a conventional electrical outlet by circuitry of a well known type.

It is noted that the pile of logs 10 are preferably constructed of plastic or the like to mimic real logs with ashes and the like and is partially transparent to allow light from the lights 95 to diffuse therethrough to give a glowing or ember like appearance.

It is to be understood that while certain forms of the present invention have been illustrated and described herein, it is not to be limited to the specific forms or arrangement of parts described and shown.

What is claimed and desired to be secured by Letters Patent is as follows:

1. A simulator adapted to provide a user with a visual flickering image simulating burning logs comprising:

a) a frame;

b) a rotatable shaft located within the frame;

c) a motor operably rotating said shaft;

d) a light array located along said shaft and joined with said shaft to rotate therewith;

e) a flame shaped mirror mounted in said frame opposite and in line of sight with at least a portion of said light array; and f) a screen mounted relative to said frame so as to receive a flickering flame shaped image from said mirror on a rear side of said screen; said screen being sufficiently transparent from rear to front to transmit said image and to display the flickering flame shaped image on a front side of the screen so as to be adapted to be seen by a user.

2. The simulator according to claim 1 wherein:

a) said shaft has a horizontal axis of rotation and extends from near one side to near an opposite side of the frame.

3. The simulator according to claim 1 wherein:

a) said shaft is generally cylindrical.

4. The simulator according to claim 3 wherein:

a) said light array comprises a plurality of lights that are helically wound about said shaft.

5. The simulator according to claim 4 wherein:

a) said lights are LED type lights.

6. The simulator according to claim 5 including:

a) an electrical wiring system providing electricity to illuminate the lights through a contact as said shaft rotates.

7. The simulator according to claim 5 wherein:

a) said lights discharge a spectrum of light in the yellow-orange range so as to mimic flame color.

8. The simulator according to claim 1 including:

a) a heater; and b) controls to allow a user to select between the flickering image, the heater, both on together, and both off.

9. In a fireplace simulator having a simulated flickering flame effect generation assembly, the improvement comprising:

a) a rotating device with a light array thereon;

b) a mirror having a flame shaped pattern and positioned in line of sight of a portion of the light array; and c) a screen that is positioned to receive a light image reflected by said mirror on a rear side of said screen; said screen being able to transmit light from the rear to a front side thereof such that said image appears on the front side of the screen so as to be adapted to be viewable there by an user.

10. The simulator according to claim 9 wherein:

a) said light array includes a plurality of LED lights and each of the LED lights emits a yellow-orange spectrum when illuminated.

11. The simulator according to claim 9 including:

a) a non combustible log display located in front of said screen and such that said light image appears behind the log display.

12. The simulator according to claim 9 wherein:

a) the screen is a one way mirror type device and reflective on the front side thereof.

* * * * *